United States Patent [19]

Faltin

[11] Patent Number: 4,854,204

[45] Date of Patent: Aug. 8, 1989

[54] ROTARY KNIFE PAPER TRIMMER WITH LONG LIFE SHEARING SURFACES FOR TRIMMING THICK AND SHINGLED PAPER PRODUCTS

[75] Inventor: Hans G. Faltin, York, Pa.

[73] Assignee: AM International Incorporated, Chicago, Ill.

[21] Appl. No.: 163,830

[22] Filed: Mar. 3, 1988

[51] Int. Cl.[4] ..... B26D 1/24

[52] U.S. Cl. ..... 83/500; 83/676; 83/698

[58] Field of Search ..... 83/13, 500, 501, 502, 83/503, 508, 495, 496, 665, 675, 676, 700, 698, 699; 76/101 A, 101 R

[56] References Cited

U.S. PATENT DOCUMENTS

| | | | |
|---|---|---|---|
| 852,964 | 5/1907 | Koegel | 83/676 X |
| 1,090,533 | 3/1914 | Heinkel | 76/101 A |
| 3,367,225 | 2/1968 | Stanford et al. | 83/501 X |
| 3,651,728 | 3/1972 | Young | 83/503 X |
| 3,813,981 | 6/1974 | Faltin | 83/500 |
| 4,274,319 | 6/1981 | Frye et al. | 83/500 X |
| 4,280,386 | 7/1981 | Ward, Sr. | 83/500 |
| 4,480,518 | 11/1984 | Futterer | 83/508 |

*Primary Examiner*—Frank T. Yost
*Assistant Examiner*—Eugenia A. Jones
*Attorney, Agent, or Firm*—Tarolli, Sundheim & Covell

[57] ABSTRACT

Significant improvements in the life of cutting knife blades and the quality of shearing of thick multiple sheet and shingled paper products are produced in a paper trimming system having two circular rotatable knives mounted to overlap at a shearing station through which the paper products are passed. Thin steel annular disc cutting blades with teeth about the outer circumference are significantly improved in life by eliminating the effects of blade warping and non-continuous mating contact with a bed knife cutting surface in an adjacent shearing relationship that is not broken by intervention of sheared paper or out of round knife surfaces or by deflection of the cutting blade away from mating surface contact by the pressure of thick or shingled paper products. Friction and wear is reduced by inclination of the cutting blade to prevent continuous rubbing against sheared paper edges. These problems are resolved by dishing and mounting the thin flexible annular disc cutting knife at a small angle away from perpendicular to the axes of rotation of the knives and by supporting its outer circumference to prevent deflection away from mating contact with the bed knife cutting surface. Thus, the cutting edges between the two rotary knives remain in continuous contact to produce clean cuts without raggedness in the presence of heavy loading from thick many paged paper products even when shingled to present a succession of step function increases of cutting loads.

3 Claims, 3 Drawing Sheets

ROTARY KNIFE PAPER TRIMMER WITH LONG LIFE SHEARING SURFACES FOR TRIMMING THICK AND SHINGLED PAPER PRODUCTS

TECHNICAL FIELD

This invention relates to rotary knife trimmers for continuously moving streams of multiple sheet paper products, and more particularly it relates to such trimmers having thin annular disc cutting knife blades with serrations about the outer circumference arranged to contact over a peripheral arc the planar cutting surface of a bed knife disposed perpendicular to the axis of rotation at a shearing station disposed in the stream of paper products.

BACKGROUND ART

Serrated rotary knife paper trimmers for streams of paper products are known in the art. My U.S. Pat. No. 3,813,981 issued June 4, 1974 for Paper Trimming Knife System has an annular disc cutting knife with peripheral teeth overlapping in an arc and registered against a planar cutting surface of a rotary bed knife. U.S. Pat. No. 4,480,518 was issued Nov. 6, 1984 to K. Futterer for Apparatus for Trimming the Marginal Portions of Paper Sheets or the like. Therein radially disposed cutting knives are disposed for rotary contact with stationary counterknives to sequentially present a succession of shearing blades through the thickness of the product before engaging a surface of the counterknife.

In the prior paper trimming art there are several significant unsolved problems, generally resulting in high power drive requirements, short cutting blade life and ragged cutting edges. The problems are exaggerated when the thickness of the paper products is great as in the case of magazines for example, and when the products are shingled so that the cutting loads are not constant but vary over a succession of step function increases in loading. Heretofore, there has been no satisfactory solution to these blade life, loading and quality of cut problems presented with thicker shingled paper products at high conveyance speeds.

It is therefore an objective of this invention to solve these prior art problems and to provide a rotary paper trimming system that produces unexpected increases of knife life and quality of cut.

A further object of the invention is to provide improved methods of trimming thick shingled streams of fast moving paper products.

A still further object of the invention is to reduce power requirements, heat and friction in the trimming of paper products, and to significantly increase the lifetime of the cutting blades in standard or heavy duty applications.

DISCLOSURE OF THE INVENTION

This invention, by means of changes in the principle of operation and the construction of the knives, converts the two mating rotary knife paper product trimming equipment of the type set forth in my patent to heavy duty trimming of very thick shingled paper products without deterioration or raggedness of the cut edge of the paper and surprisingly with significantly extended blade life. It solves explicitly prior art problems of wear, trimming quality, power, frictional heat, difficulties in the manufacture of blades and the trimming of thick shingled paper products passed at high speeds past a shearing station.

It has been found in accordance with this invention that major problems are interposed in the quality of cutting and the friction and wear on the blades when thick shingled products deflect the cutting knife blade surface away from mating contact with the bed knife cutting surface. Even hardened steel cutting blades are deflected away from the shearing surface of the bed knife when the blades must already start cutting many sheet thicknesses before reaching the shearing action of the two knife blades as they overlap in mutual contact at the shearing station. Because of the paper friction and pressure on the blades the trimmed edges and/or the edges of the products may then be forced between the blades to significantly increase load, friction and wear. Clean cutting is achieved only when the cutting and bed knives are in mutual contact at the shearing edge, and thus deflection of the cutting blade will deteriorate the quality of the cut.

Further it has been found in accordance with this invention that in manufacture and tempering of annular disc toothed cutting blades, there is no feasible commercial way to assure that the cutting blades have a flat planar cutting surface. They are in fact stressed by tempering so that they become warped and wavy about the circumferential cutting tooth edge. This also causes undesirable gaps or interference wearing off the teeth between the shearing edges of the two knives, thereby causing ragged edges and the tendency to force paper between the two knives.

Also it has been found in accordance with this invention that the continuous frictional contact of the edges of the paper products being transported past the cutting blade significantly wears the blade at the critical toothed cutting edge.

All this is prevented by a novel structural arrangement of the two blades to produce shearing action between the two blades while in mutual mating contact in accordance with a preferred embodiment of the invention. The specific blade configuration afforded herein not only produces a quality cut but also resolves the other problems of blade flatness, increased wear, excessive heat and high power requirements by eliminating the frictional paper to blade loading.

Thus, in accordance with this invention, the annular cutting blade disc is clamped in a rotary knife holder in a dished configuration with the outer circumferential toothed edge being in a single plane for mating with the cutting surface of the bed knife, thereby to achieve several operating advantages. The cutting blade thus has its inner circumference moved away from the edges of the sheared paper products to relieve the frictional contact and wear. The dished configuration strengthens the stiffness of the knife to deflecting forces and further eliminates the waviness introduced in the tempering process. The dished knife is ground at the toothed circumference to present a surface substantially parallel to the axes of rotation of the blades thereby to assure mated sliding contact between the shearing surfaces of the two rotary knives without modification to the bed knife.

Further the rotating cutting blade holding structure provides a backup support at the outer circumference cutting tooth periphery on the side of the disc away from the bed knife contact surface, further to assure that the cutting blade cannot be deflected away from its mating shearing contact with the bed knife cutting surface by paper contact forces.

The resulting trimmer embodiment has been found to produce quality cut edges without raggedness for trimming thick magazines and in other heavy duty trimming operations with shingled paper products, while unexpectedly increasing the life of the cutting blades by at least an order of magnitude over the conventional rotary knife trimmer of my aforesaid patent.

THE PREFERRED EMBODIMENT

Figure 1:
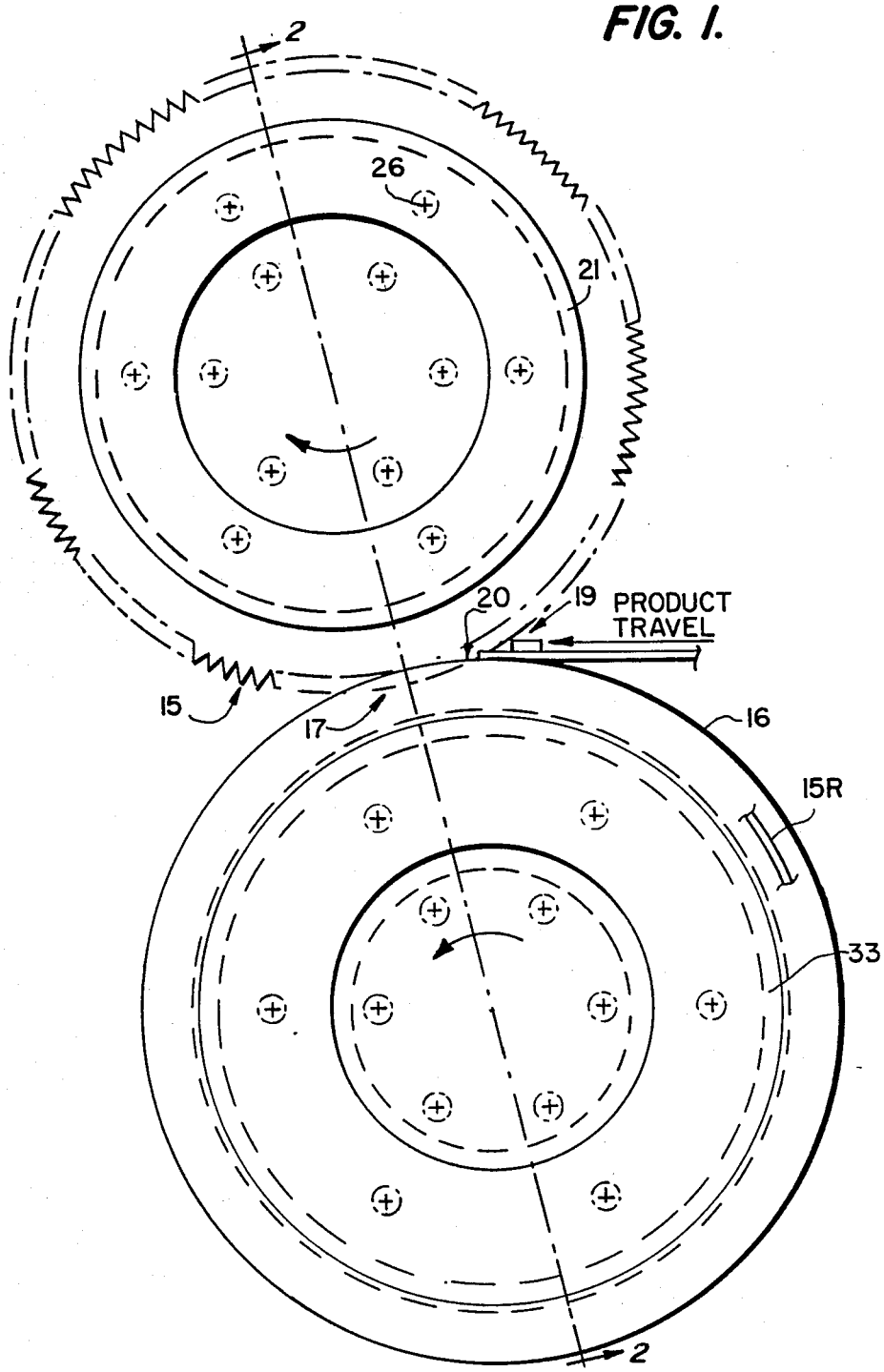
FIG. 1 is an end view sketch of two cutting knives in a paper trimming system according to this invention.

It may be seen from FIG. 1 that the rotary knives are of the general type incorporated in the system of my U.S. Pat. No. 3,813,981. Thus, the serrated cutting knife blade 15 overlaps the bed knife 16 over an arc 17 at a shearing station for receiving and shearing a multiple sheet paper product 18 which is moving, as the arrow shows, through the cutting station by means of a conveyor not shown. Note that the product may be shingled 19 to present a succession of step increases in shearing loads to the intersection 20 of the knives where the cutting takes place much in the fashion of an ordinary pair of scissors. There is a limiting circumferential ring 15R on the planar cutting surface 16C of the bed knife, shown in part. Thus, the overlap of the two knives does not exceed as far as the indented circular groove 33 in the bed knife surface.

Figure 2:
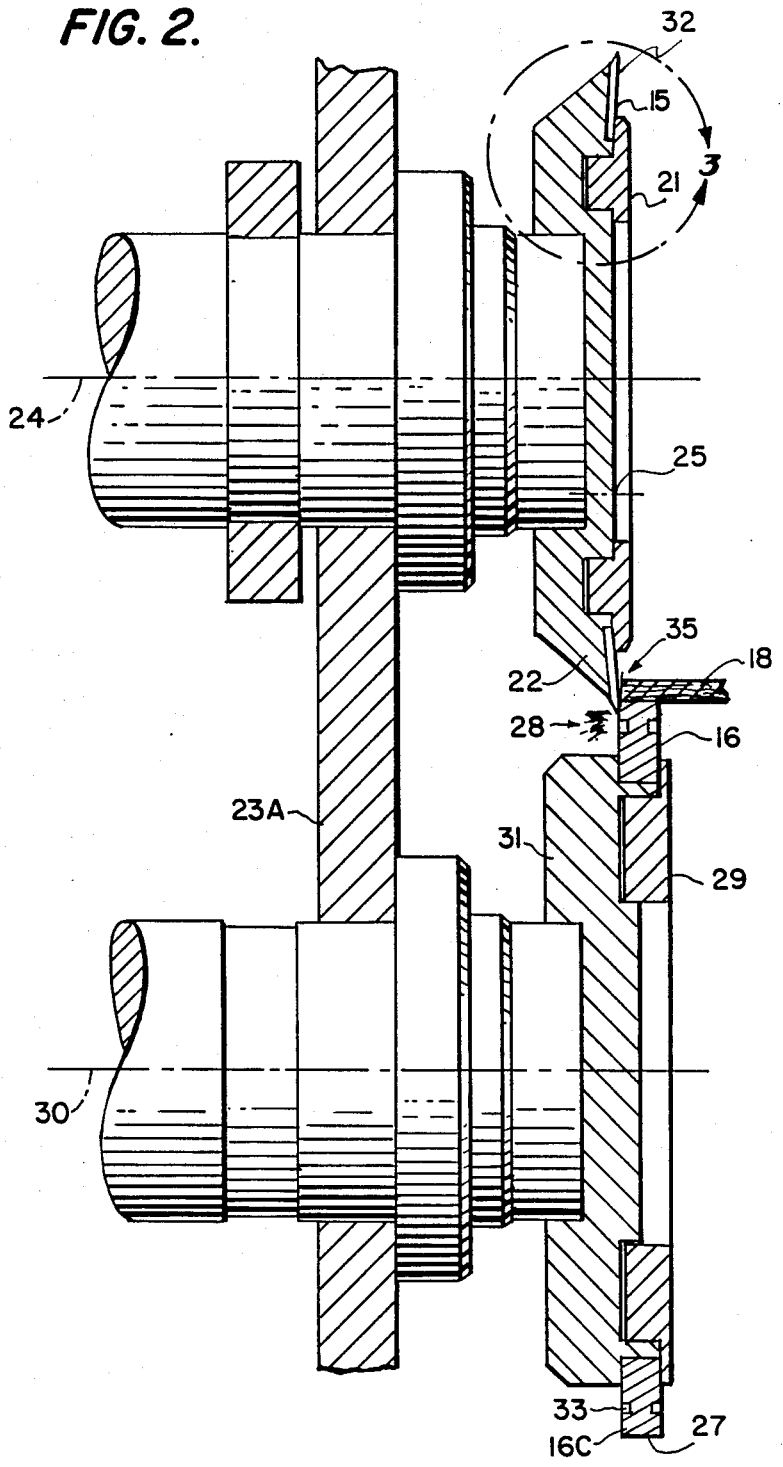
FIG. 2 is a segmental side view sketch, partly in section of the cutting wheels in FIG. 1.

As may be better seen with reference also to FIG. 2, the cutting blade 15 is a thin hardened steel annular disc clamped in place by fixture 21 on the rotatable cutting blade holder jig 22, which in turn is rotated on a spindle 23 appropriately journalled in the frame 23A of a trimmer system assembly to rotate about axis 24. The clamping fixture 21 is bolted onto the blade holder jig 22 by bolts not shown in FIG. 2 except by section lines 25, etc., and suggested in FIG. 1 by the crosses 26, etc.

Similarly the rotatable bed knife having a substantially cylindrical outer circumferential portion 27 presenting an outer circumferential surface upon which the paper product 18 is supported as the cutting blade teeth are forced through its thickness at a position in the travel path before the shearing edges of the two knives 15, 16 intersect at the shearing point 20 (FIG. 1). The trimmed edges 28 are waste products adequately disposed of by vacuum means or the like, not shown. The bed knife is similarly clamped by clamping member 29 onto a rotary jig 31 revolving about axis 30 parallel to axis 24.

Typically the cutting disc 15 is an annular tempered steel knife of a Rockwell Hardness of 60 to 64 having an outer diameter of nine inches (23 cm), an inner diameter of six and five-eighths inches (17 cm), and a thickness of 0.090 inches (0.23 cm) with planar opposing surfaces. The disc is tempered after forming the teeth and thus it is difficult if not impossible to keep the surfaces flat. Thus the discs can be expected to be wavy with the toothed cutting edges 32 not lying in a single plane. This raises a significant problem in the quality of the cut because it has not been possible in the prior art to assure that the critical shearing edges between the two knives is always in contact. If not in contact, the edges are torn and ragged, not sheared. Even worse, the ragged paper edges may be forced down into the gap between the blades and tend to deflect the cutting edge of the disc 15 outwardly more away from the cutting surface edge of the bed knife 16. This thus requires overloading and further deflection of the top serrated knife causing more friction and poor shearing quality, and it tends to occur particularly with heavy loads from thick magazines or thick shingled products where the thicknesses have step functions periodically presented to the shearing station.

The bed knife 16 is thick and rigid, and may be machined to have a planar cutting knife contact surface perpendicular to the axes of rotation 24, 30. As may be seen in FIGS. 1 and 2, the bed knife surface is relieved at 33 radially inwardly from the innermost circumferential ring 15R at which the serrations slide on the planar cutting surface 16C disposed perpendicular to the axis of rotation. This affords cleaner disposal of the trimmed off waste 28.

The life of the cutting system is dependent upon blade life, and the toothed cutting edge of the cutting knife is critical. Various factors contribute to its life. Thus, the frictional contact of the product 18 on the outer cutting edge region of blade 15 produces significant wear. Also any interference of the cutting edges of the blade 15 with the rigid outer circumference of the bed knife 16 due to waviness will rapidly wear the critical thin toothed edge. Thus, when heavily loaded by thick and shingled products, the cutting blade 15 has a short life and need be replaced often in the prior art.

The top knife 15 needs to travel at a speed of at least three to fifteen times faster than the bottom bed knife. The faster the top knife travels in relationship to the bed knife, the greater the wear. Also the larger the diameter of the knives, the greater thickness of the cut. When the diameters are larger, the deflection of the top cutting knife is greater. Thus, for heavy thick cutting loads, there is more blade deflection, more wear, and more friction of the knife with the paper product resulting in more friction and heat and power expenditure.

Axial adjustments of the cutting knife assembly are not shown but they permit adjustment of the cutting disc assembly so that there is mutual mating contact in the overlapping arc area with the cutting surface of the bed knife, namely the surface adjacent the waste 28 trimmed off the product in FIG. 2. If adjusted properly, and if the mating overlapped blade surfaces are parallel, then the wear of the cutting knife blade tip 32 and loading with heat generation from the surface mating contact is not significant. However, if adjustments are made in the field to compensate for outward deflection of the cutting blade 15 away from the mating surface to permit paper from the product 18 to be wedged in and cause ragged edges, then the wear factors of interference and friction from the paper and heat from the loading will cause rapid wear. With larger diameter knives, higher speeds of rotation, thicker and shingled paper products, more and more pressure forcing the cutting knife against the bed knife cutting surface increases friction, power and wear.

Figure 3:
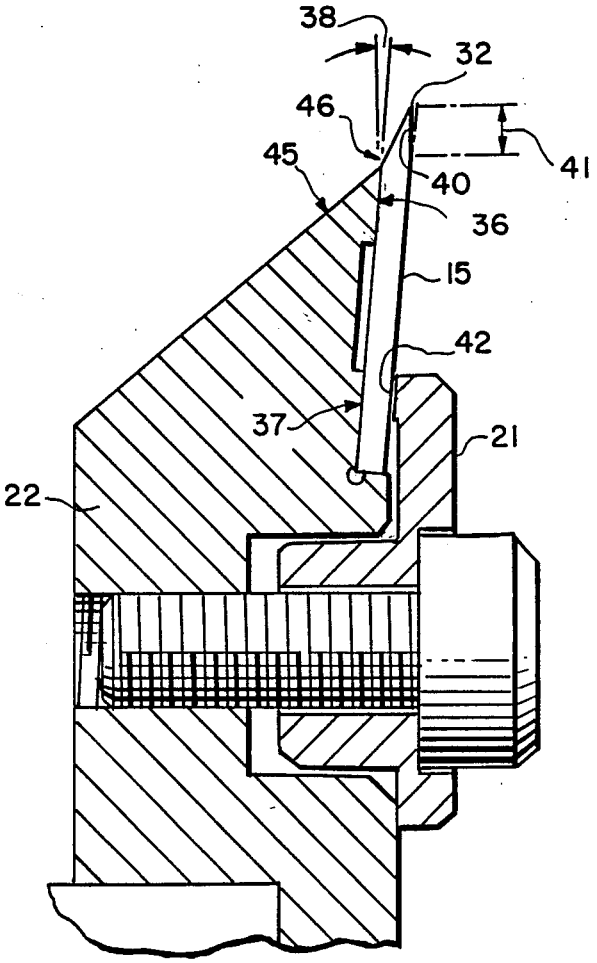
FIG. 3 is an enlarged segmental side view, partly in section of the rotary cutting knife holder means encompassed in FIG. 2.

By reference to FIG. 3, it will be seen that the problems of the prior art are resolved to provide unexpectedly longer cutting blade life and clean cuts without ragged edges under heavy loads with thick magazines and shingled many paged paper products. It will be noted that several critical structural changes are made to the rotary cutting knife holding assembly. Thus, the blade 15 is seated upon two surfaces 36, 37 of the rotary holder jig 22 to place the shown cross section of the blade at an angle 38 away from perpendicular to the axes of rotation. The angle typically may be forty five minutes. The clamping member 21, which does not touch its mating cylinder walls abuts the blade 15 and thus serves to dish the annular ring disc of the knife 15 at its inner circumference in a direction away from the critical mating surface of the toothed outer peripheral edge 40. The cutting surface 40 of the bed knife is disposed substantially normally to its axis of rotation.

This dishing critically changes the performance of the cutting knife disc in several respects. It strengthens it mechanically from deflection of its toothed outer edge away from the bed knife mating surface. It relieves the frictional loading and resulting heat and wear from the paper product passing through the knives. This is seen better from FIG. 2 at the critical wear position 35, where the blade 15 is angled away from the cut edges of the paper product 18. Also it tends to present the outer cutting edge of cutting blade 15 in a planar surface for matching that of the bed knife, thereby overcoming the waviness imparted by heat treatment. All of these factors contribute to the long life and clean cutting that is obtained from this improvement. The life of the blade has been extended more than tenfold in the presence of heavy loads, and the cuts are clean without raggedness. It is also significant that the power required in handling such heavy loads has been decreased to one-third and corresponding heat problems have been eliminated.

Since the angle of the blade 15 is changed, a corresponding misfit at the outer contact surface 40 is now corrected by grinding the outer periphery to be perpendicular to the axes of rotation of the two knives as indicated by the angle 41. This is done in a grinding jig similarly dishing the cutting knife blade to that necessary in the operating trimming system. It is also noted that the clamping surface 42 on clamp 21 is ground at an angle matching the angle 38. Thus, the sliding contact of the mating cutting and bed knives over the arcuate overlap area at the shearing station is ascertained to be continuous without gaps due to warping of the discs.

The so clamped and dished annular disc 15 may be generally closely related to a frustro-conical section of a flat cone approaching a planar configuration.

Also included in this preferred embodiment of the invention is further structure to prevent deflection of the outer periphery of the cutting knife blade away from the sliding mating surface with the bed knife. Thus it may be seen that the cutting knife holder jig 22 is extended to the outer periphery of the cutting blade 15 to form the stiffening support region 45 out to the base of the teeth beveling at 46. This further assures that the cutting blade may not be deflected away from the bed knife cutting surface to permit ragged edges and the problem of jamming paper between the knives.

It is therefore evident that critical structural improvements are afforded by this invention in the art of paper trimming systems using two rotary knives, so that cutting is cleaner, thereby avoiding raggedness at the cut paper edge, and blade life is significantly extended. The new principle of operation afforded by this invention has thus overcome long outstanding problems of blade wear and cutting quality in the art, particularly in the presence of heavy loading with thick or shingled products. Therefore, those novel features believed definitive of the nature and spirit of this invention are set forth with particularity in the following claims.

I claim:

1. In a paper trimming system having two substantially circular knives rotatable about respective axes of rotation and mounted to overlap over an arc at a shearing station for receiving, transporting, and shearing a multiple sheet paper product, the improvement for reducing cutting blade wear; reduction of friction, heat and power; and for better cutting action with thick paper products comprising, a rotary bed knife with a substantially cylindrical outer circumferential portion upon which the paper product rides and a substantially planar cutting surface disposed substantially normally to its axis of rotation, rotary bed knife holder means for rotatably mounting said bed knife to present an outer circumferential arc at said shearing station, a cutting knife blade comprising a circular annular disc with cutting teeth on the outer circumference for presenting a substantially planar circumferential cutting surface for mating with the cutting surface of the bed knife in a sliding relationship at said shearing station, rotary cutting knife blade holder means for rotatably mounting said cutting knife blade to overlap the rotary bed knife in said arc at the shearing station in sliding contact, and clamping means for changing the configuration of said cutting knife blade from an initial configuration to a generally frustro-conical dished configuration which is different than the initial configuration and for holding the cutting knife blade on the rotary cutting knife blade holder means in the frustro-conical dished configuration deflected inwardly from the outer circumference in a direction away from the bed knife, thereby to engage the cutting surface of the bed knife only at a narrow circumferential band about the cutting knife to reduce friction and heat, said cutting knife blade having a ground circumferential surface band which slidably engages the cutting surface on said rotary bed knife and a bevel surface which intersects said ground circumferential surface band and is disposed on a side of said cutting knife blade opposite from said ground circumferential surface band, said rotary cutting knife blade holder means having a support surface which engages said cutting knife blade at a location adjacent to an inner edge of the bevel surface to resist deflection of the cutting blade away from its sliding contact with said bed knife in the presence of paper products being cut.

2. The improvement of claim 1 wherein, said cutting knife blade is of hardened steel of a Rockwell hardness of the order of 60 and dimensions in the order of ten inches (25 cm) in outer diameter and seven inches (18 cm) in inner diameter having opposed transverse faces forming an annular sheet with a thickness therebetween of the order of 0.1 inch (0.25 cm) such that the blade sheet may be deflected for clamping in said dished configuration of the blade.

3. The improvement of claim 1 further comprising, means in said cutting knife blade holder cooperating with said support surface for holding the annular knife blade in said dished configuration as a generally shallow conical segment with an inclination from normal to the axis of rotation of the blade thereby stiffening the blade to reduce the tendency to deflect away from the sliding surface in the presence of paper products being cut.

* * * * *